US009533508B2

(12) United States Patent
Anderson, Jr. et al.

(10) Patent No.: US 9,533,508 B2
(45) Date of Patent: Jan. 3, 2017

(54) PRINTHEAD

(71) Applicant: FUNAI ELECTRIC CO., LTD., Osaka (JP)

(72) Inventors: James Daniel Anderson, Jr., Harrodsburg, KY (US); Sean Weaver, Walton, KY (US); Greg Long, Georgetown, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days.

(21) Appl. No.: 14/292,080

(22) Filed: May 30, 2014

(65) Prior Publication Data

US 2015/0343788 A1 Dec. 3, 2015

(51) Int. Cl.

*B41J 2/175* (2006.01)
*B41J 2/195* (2006.01)
*B41J 2/015* (2006.01)

(52) U.S. Cl.

CPC ..... *B41J 2/17503* (2013.01); *B41J 2/1753* (2013.01); *B41J 2/17513* (2013.01); *B41J 2/17553* (2013.01); *B41J 2/17563* (2013.01)

(58) Field of Classification Search

CPC . B41J 2/17513; B41J 2/17533; B41J 2/17509; B41J 2/17556; B41J 2/17523; B41J 2/17503; B41J 2002/17516; B41J 2/1752; B41J 2/17563

USPC ..... 347/7, 20, 29, 84–87

See application file for complete search history.

(56) References Cited

U.S. PATENT DOCUMENTS

| | | | | |
|---|---|---|---|---|
| 5,381,172 | A | 1/1995 | Ujita et al. | |
| 5,509,140 | A | 4/1996 | Koitabashi et al. | |
| 8,066,363 | B2 | 11/2011 | Greer et al. | |
| 2001/0033314 | A1 | 10/2001 | Yoshino et al. | |
| 2003/0160847 | A1* | 8/2003 | Tsujimoto | B41J 2/17553 347/86 |
| 2005/0068394 | A1* | 3/2005 | Inoue et al. | 347/93 |
| 2008/0231675 | A1* | 9/2008 | Hattori | B41J 2/17513 347/86 |
| 2009/0303299 | A1* | 12/2009 | Gilson et al. | 347/86 |
| 2013/0314481 | A1 | 11/2013 | Gilson et al. | |

FOREIGN PATENT DOCUMENTS

EP 0759362 A1 2/1997

* cited by examiner

*Primary Examiner* — Jannelle M Lebron
(74) *Attorney, Agent, or Firm* — Amster, Rothstein Ebenstein LLP

(57) ABSTRACT

A printhead assembly including an ink cartridge body made of a material selected from the group of materials consisting of: nylon, polyethersulfone, polypropylene, polyethylene, polyoxymethylene and other materials that are compatible with ketone, acetate and alcohol based inks, an ink reservoir disposed within the ink cartridge body and adapted to receive and contain ink, and a printhead chip provided on the ink cartridge body and in fluid communication with the ink reservoir so as to receive ink from the ink reservoir for ejection of the ink onto a print medium.

20 Claims, 6 Drawing Sheets

PRINTHEAD

FIELD

The present invention relates generally to inkjet printers, and more particularly, to printhead assemblies for inkjet printers.

BACKGROUND

An ink jet printer typically includes a printhead and a carrier. The ink jet printhead can comprise a printhead body, nozzles, and corresponding ink ejection actuators, such as heaters on a printhead chip. The actuators cause ink to be ejected from the nozzles onto a print medium at selected ink dot locations within an image area. The carrier moves the printhead relative to the medium, while the ink dots are jetted onto selected pixel locations, such as by heating the ink at the nozzles.

In some such systems, the ink reservoir comprises a removable or separable tank, such that the tank can be separated from the printhead, and replaced or refilled, when the ink is low. The printhead components can then be re-used. In such ink tank systems, a separable fluid connection between the tank and the printhead body is needed, in contrast to systems where the printhead body is integral with the ink reservoir. The connection permits ink to flow to the nozzles from the tank, but is separable such that the ink tank can be removed when empty. The printhead assembly can also include a filter within an ink passageway leading from the ink reservoir to the nozzles, for isolating any contaminants or debris from the ejectors and nozzles.

In the industrial market, the proliferation of digital printing is underway. This proliferation provides a unique opportunity for thermal inkjet technology, due to low cost points associated with the bill of materials (BOM) and manufacturing of thermal inkjet printers. The printhead requirements for the industrial market is different and more challenging due to the non-traditional inks being used. The ink chemistries, which are solvent UV curable and latex based, are formulated to wet, penetrate and adhere to non-porous medias (examples of the various substrates are mentioned above). Solvents that are typically used generally have lower surface tension compared to water and will wet lower surface energy surfaces/substrates. Another property that the solvent system provides is the ability of the solvent to cause interfacial diffusion of ink into the substrate allowing for improved adhesion and durability. This is critical due to the non-porous nature of the various substrates used in the industry and the fact that the printed media will be subjected to various environments. Ketones and acetates such as methyl ethyl ketone (MEK) or ethyl acetate are some of the most aggressive solvents used in solvent ink formulations. Currently MEK based inks provide a significant advantage over alcohol-based inks because of its ability to wet and adhere to various plastic (polyolefin base substrates) in a variety of packaging applications/markets.

SUMMARY OF THE INVENTION

Currently, there is not a thermal inkjet printhead that can withstand the aggressive nature of MEK. Accordingly, an object of the present invention is to provide an inkjet printhead that can store and deliver MEK based inks to a substrate.

Another object of the present invention is to provide an inkjet printhead that exhibits a good seal during normal shipping environments. Due to the nature of the design of the MEK jetting printhead of the present invention, there is a need to completely seal the printhead during shipping so as to prevent leakage of the solvent into the shipping materials.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
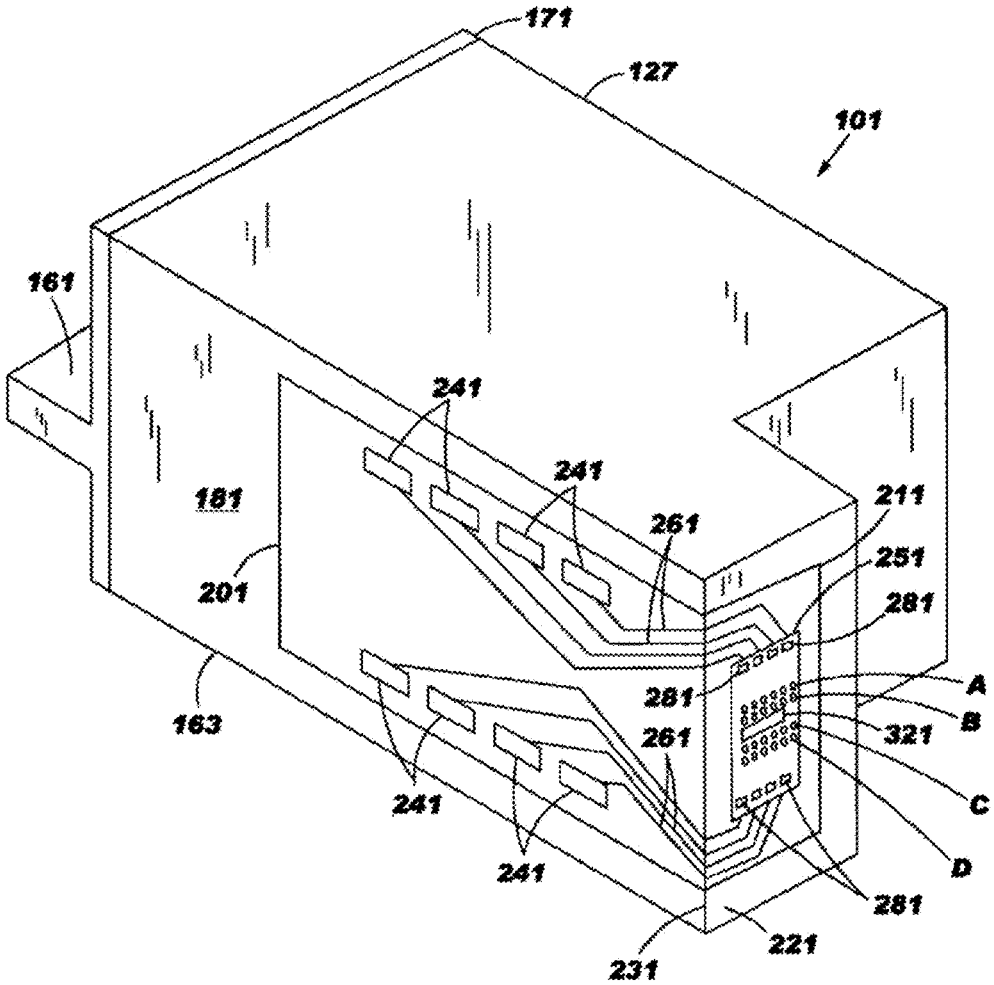
FIG. 1 is a perspective view of a conventional printhead.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

FIG. 1 shows an inkjet printhead generally designated by reference number 101. The printhead 101 has a housing 127 formed of a lid 161 and a body 163 assembled together through attachment or connection of a lid bottom surface and a body top surface at interface 171. The shape of the housing varies and depends upon the external device that carries or contains the printhead, the amount of ink to be contained in the printhead and whether the printhead contains one or more varieties of ink. In any embodiment, the housing or body has at least one compartment in an interior thereof for holding an initial or refillable supply of ink and a structure, such as a foam insert, lung or other, for maintaining appropriate backpressure in the inkjet printhead during use. In one embodiment, the internal compartment includes three chambers for containing three supplies of ink, especially cyan, magenta and yellow ink. In other embodiments, the compartment contains black ink, photo-ink and/or plurals of cyan, magenta or yellow ink. It will be appreciated that fluid connections (not shown) may exist to connect the compartment(s) to a remote source of bulk ink.

A portion 205 of a tape automated bond (TAB) circuit 201 adheres to one surface 181 of the housing while another portion 211 adheres to another surface 221. As shown, the two surfaces 181, 221 exist perpendicularly to one another about an edge 231. The TAB circuit 201 has a plurality of input/output (I/O) connectors 241 fabricated thereon for electrically connecting a heater chip 251 to an external device, such as a printer, fax machine, copier, photo-printer, plotter, all-in-one, etc., during use. Pluralities of electrical conductors 261 exist on the TAB circuit 201 to electrically connect and short the I/O connectors 241 to the bond pads 281 of the heater chip 251 and various manufacturing techniques are known for facilitating such connections. It will be appreciated that while eight I/O connectors 241, eight electrical conductors 261 and eight bond pads 281 are shown, any number are embraced herein. It is also to be appreciated that such number of connectors, conductors and bond pads may not be equal to one another.

The heater chip 251 contains at least one ink via 321 that fluidly connects to a supply of ink in an interior of the housing. Typically, the number of ink vias of the heater chip corresponds one-to-one with the number of ink types contained within the housing interior. The vias usually reside side-by-side or end-to-end. During printhead manufacturing, the heater chip 251 preferably attaches to the housing with any of a variety of adhesives, epoxies, etc. well known in the art. As shown, the heater chip contains four rows (rows A-row D) of fluid firing elements, especially resistive heating elements, or heaters. For simplicity, dots depict the heaters in the rows and typical printheads contain hundreds of heaters. It will be appreciated that the heaters of the heater chip preferably become formed as a series of thin film layers made via growth, deposition, masking, photolithography and/or etching or other processing steps. A nozzle plate, shown in other figures, with pluralities of nozzle holes adheres over or is fabricated with the heater chip during thin film processing such that the nozzle holes align with the heaters for ejecting ink during use. Alternatively, the heater chip is merely a semiconductor die that contains piezoelectric elements, as the fluid firing elements, for electromechanically ejecting ink. As broadly recited herein, however, the term heater chip will encompass both embodiments despite the name "heater" implying an electro-thermal ejection of ink. Even further, the entirety of the heater chip may be configured as a side-shooter structure instead of the roof-shooter structure shown.

Figure 2:
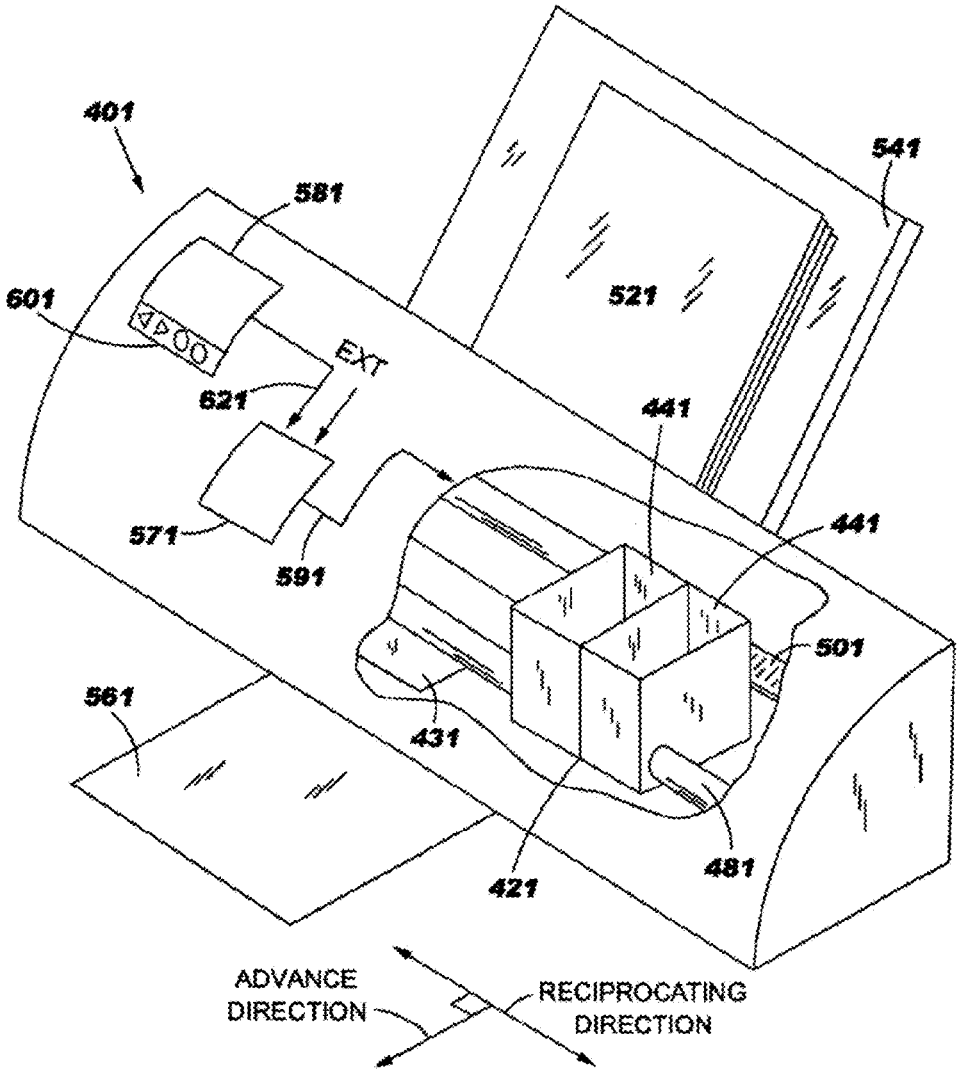
FIG. 2 is a perspective view of a conventional inkjet printer useable with the printhead assembly according to an exemplary embodiment of the present invention.

FIG. 2 shows an external device in the form of an inkjet printer for containing the printhead 101, generally designated by reference number 401. The printer 401 includes a carriage 421 having a plurality of slots 441 for containing one or more printheads. The carriage 421 is caused to reciprocate (via an output 591 of a controller 571) along a shaft 481 above a print zone 431 by a motive force supplied to a drive belt 501 as is well known in the art. The reciprocation of the carriage 421 is performed relative to a print medium, such as a sheet of paper 521, that is advanced in the printer 401 along a paper path from an input tray 541, through the print zone 431, to an output tray 561.

In the print zone, the carriage 421 reciprocates in the Reciprocating Direction generally perpendicularly to the paper Advance Direction as shown by the arrows Ink drops from the printheads are caused to be ejected from the heater chip 251 (FIG. 1) at such times pursuant to commands of a printer microprocessor or other controller 571. The timing of the ink drop emissions corresponds to a pattern of pixels of the image being printed. Often times, such patterns are generated in devices electrically connected to the controller (via Ext. input) that are external to the printer such as a computer, a scanner, a camera, a visual display unit, a personal data assistant, or other. A control panel 581 having user selection interface 601 may also provide input 621 to the controller 571 to enable additional printer capabilities and robustness.

To print or emit a single drop of ink, the fluid firing elements (the dots of rows A-D, FIG. 1) are uniquely addressed with a small amount of current to rapidly heat a small volume of ink. This causes the ink to vaporize in a local ink chamber and be ejected through the nozzle plate towards the print medium. The fire pulse required to emit such ink drop may embody a single or a split firing pulse and is received at the heater chip on an input terminal (e.g., bond pad 281) from connections between the bond pad 281, the electrical conductors 261, the I/O connectors 241 and controller 571. Internal heater chip wiring conveys the fire pulse from the input terminal to one or many of the fluid firing elements.

In order to operate within industrial printers, a printhead according to exemplary embodiments of the present invention must be able to accommodate ketone, acetate and alcohol based inks For example, certain materials that are compatible with such inks may be selected for the body and lid of the printhead and internal features and the back pressure system of the printhead may be altered as compared to conventional printheads.

Figure 3:
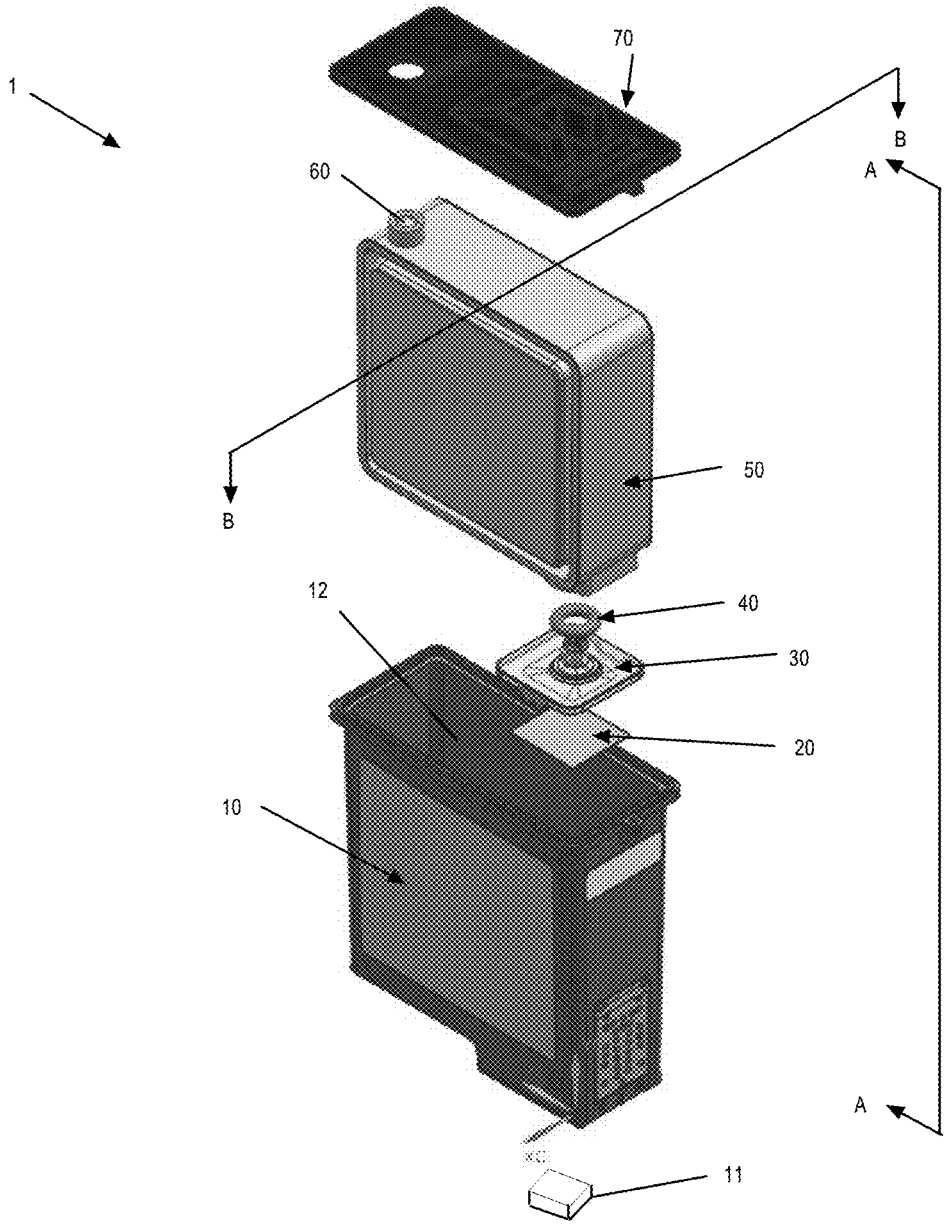
FIG. 3 is an exploded perspective view of a printhead assembly according to an exemplary embodiment of the present invention.
Figure 4:
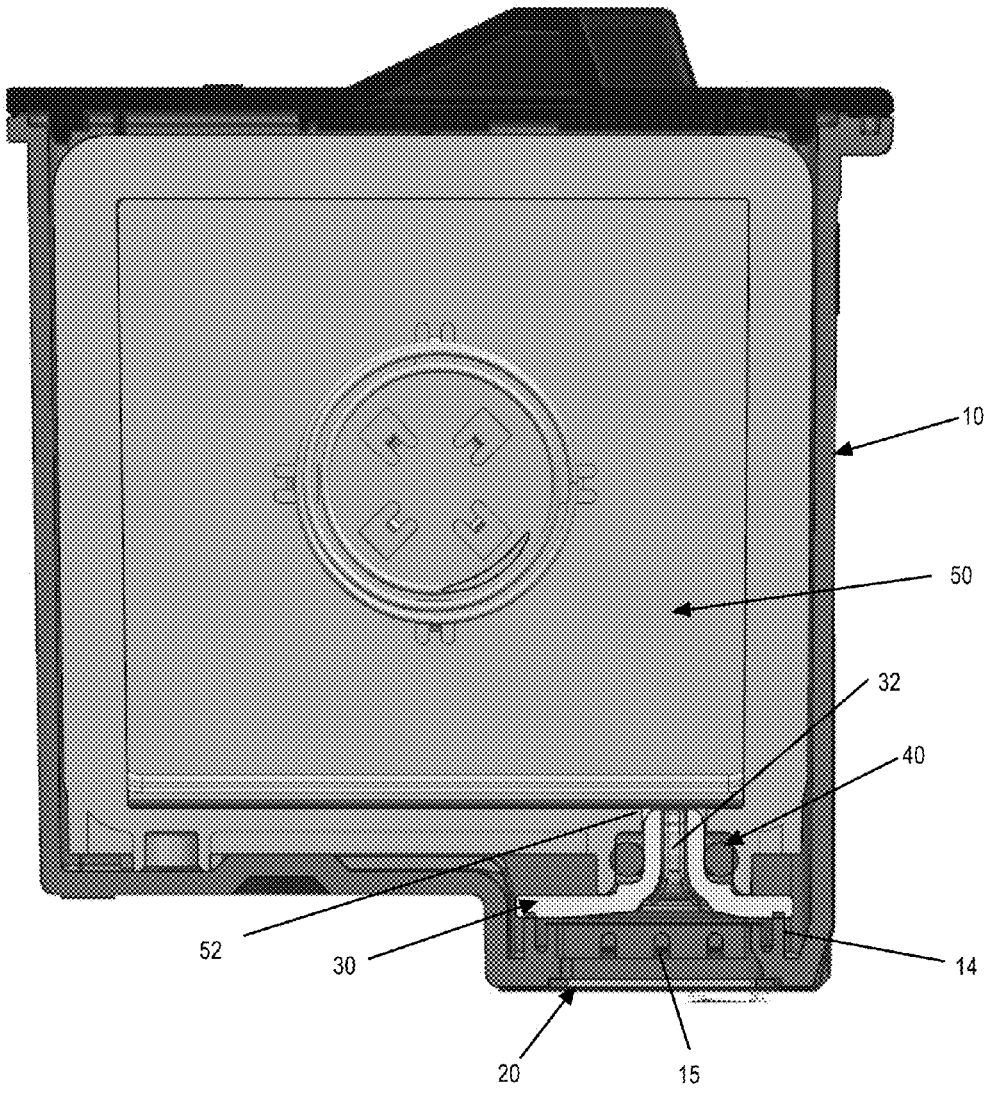
FIG. 4 is a cross-sectional view taken along the line A-A of FIG. 3.
Figure 5:
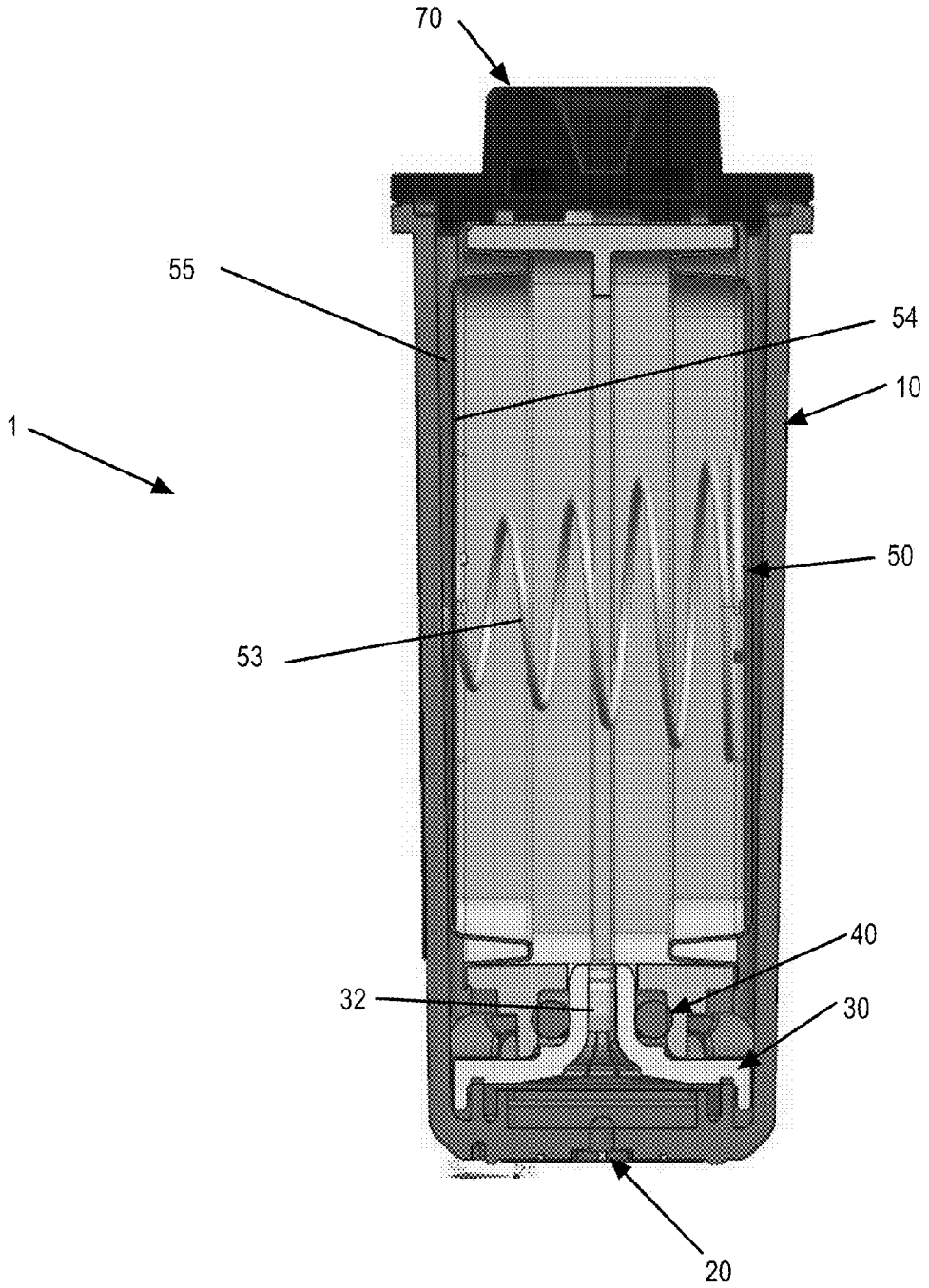
FIG. 5 is a cross-sectional view taken along the line B-B of FIG. 3.

FIG. 3 is an exploded perspective view and FIGS. 4 and 5 are cross-sectional views of a printhead assembly, generally designated as reference number 1, according to an exemplary embodiment of the present invention. The printhead assembly 1 includes an ink cartridge body 10, filter 20, filter cap 30, gasket 40, in reservoir 50, fill ball 60 and lid 70. The ink cartridge body 10 has a chamber 12 that is sized and configured to receive the ink reservoir 50. Although only one ink reservoir 50 is shown in the figures, it should be appreciated that multiple ink reservoirs may be provided to accommodate one or more color inks The ink reservoir 50 includes an exit port 52 for delivery of the ink, once installed in the chamber 12, and the port 52 can include an interface structure as appropriate, such as a lip or extension. The exit port 52 can be sealed using a removable seal, which can be removed at the time of installation.

Attached to the ink cartridge body 10 is a print head chip 11 including a plurality of nozzles for delivery of the ink to the print medium. In other embodiments, the nozzles are provided on a structure separate from the chip. The ink flows from the exit port 52 of the ink reservoir 50 through channels in the lower portion of the body 10. The ink then flows within the body 10 to a manifold in the print head chip 11, from which it is drawn to the nozzles for ejection onto the print medium, such as by using heater elements or piezoelectric elements formed in the chip 11. The system 1 is moved relative to the print medium, such that the nozzles drop ink at one or more desired locations on the medium.

The lower portion of the ink cartridge body 10 includes a tower 14. The tower 14 may include any appropriate extension, structure, port, or interface for receiving ink for printing. The tower 14 of this example includes a raised tubular extension, or standpipe, having one or more openings 15 through which the ink may flow. Other tower configurations are also possible as will be readily apparent to one of ordinary skill in the art.

As shown in FIGS. 4 and 5, the filter cap 30 engages the tower 14, and in particular may be welded to an upstanding outer perimeter wall of the tower 14. The filter cap 30 includes a conduit or guide component for providing a passage between the ink cartridge body 10 and the ink reservoir 50. In this example, the filter cap 30 includes an inner passage 32 for providing ink therethrough, the passage 32 being defined by a smaller diameter upper passage portion 34 at the ink reservoir end and a larger diameter lower passage portion 36 at the ink cartridge body end. The filter cap 30 may be made of a polyamide, such as, for example, nylon, or other suitable materials that can provide a fluid resistant seal against the tower 14, ink cartridge body 10, and/or ink reservoir 50.

The upper passage portion 34 of the filter cap 30 engages a corresponding exit port 52 of the ink reservoir 50 to allow ink to flow from the ink reservoir 50 to the passage 32 of the filter cap 30. A sealing member is disposed adjacent the filter cap 30 and assists in sealing between the filter cap 30 and the ink reservoir 50. In this example, the sealing member includes the gasket 40 that engages the upper passage portion 34, so as to create a fluidic seal to control fluid and evaporative losses from the system, and prevent air from entering the system to maintain back pressure. The gasket 40 may be made of a suitable elastomer material, or other material with good sealing properties.

The filter 20 filters contaminants in the ink from reaching the printhead chip. The filter 20 can also provide capillary functions to allow ink to pass upon demand to the printhead chip and to prevent air passage into the printhead chip. The filter 20 can be made of a metal weave, a polymer weave, or other mesh, screen, or weave materials. For instance, a stainless steel dutch twill or a stainless steel random weave material may be used to form the filter 20. The filter 20 may be insert injection molded in the tower 14, or otherwise disposed in the ink cartridge body 10. As another example, the filter 20 may be heat staked to the ink cartridge body 10.

The material used to form the ink cartridge body 10 and associated lid 70 may be, for example, Nylon 6,6, Nylon 6, Nylon 6,12, polyethersulfone, polypropylene, polyethylene, and polyoxymethylene or other materials that are compatible with ketone, acetate and alcohol base inks Since these materials exhibit vapor loss through permeation, a secondary boundary may be provided in the form of the ink reservoir 50. In this regard, the ink reservoir 50 may be made of polypropylene and/or polyethylene based materials so as to create a sufficient permeation barrier. The ink reservoir 50 is also provided to serve as a back pressure device since conventional back pressure devices are made of foam or felt materials, which are easily attacked by ketone, acetate and alcohol based inks The ink reservoir 50 provides the primary permeation boundary for the ink cartridge body 10 and when the ink reservoir 50 is attached internally to the ink cartridge body 10 and lid 70, a tortuous vent path is created having a high length to area ratio. This tortuous path allows air to move through it, while maintaining a high humidity environment, which reduces evaporative losses and greatly reduces permeation from the system.

Figure 6:
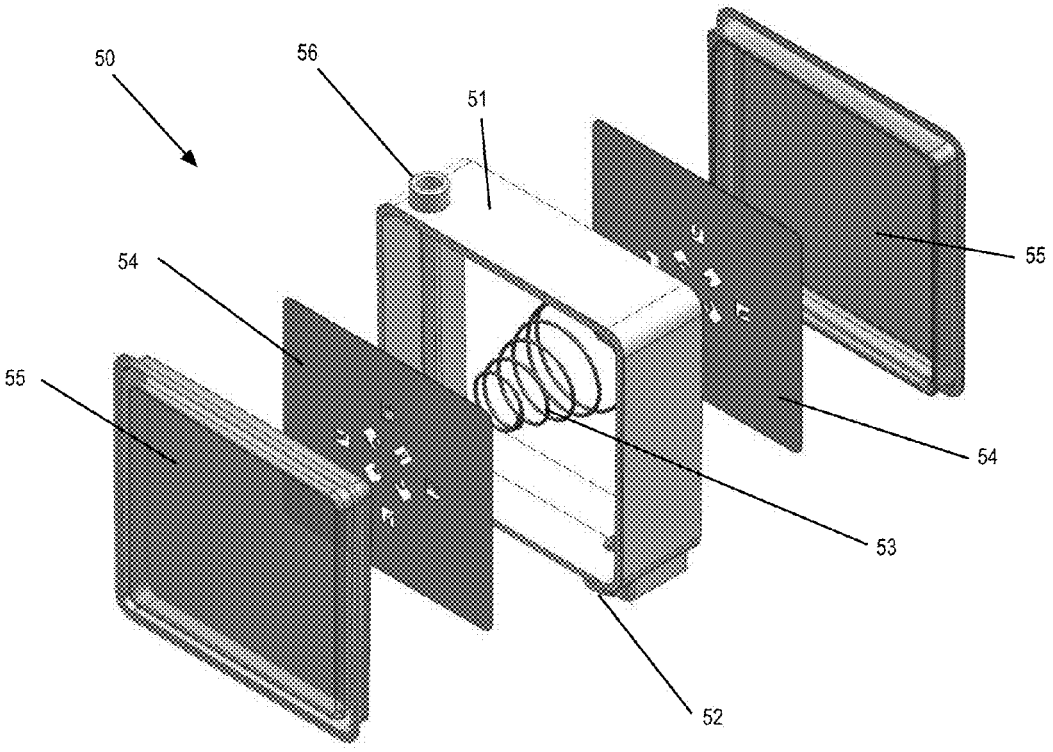
FIG. 6 is an exploded perspective view of an ink reservoir according to an exemplary embodiment of the present invention.

FIG. 6 is an exploded perspective view of the ink reservoir 50. The ink reservoir 50 is made up of a peripheral frame 51, spring 53, side plates 54, and side walls 55. The frame 51 is generally rectangular shaped and is open on both sides. The frame 51 may be made of a polypropylene and/or polyethylene based material. An ink fill hole 56 is disposed at the top of the frame 51. In this regard, the lid includes an opening 72 that corresponds with the ink fill hole 56 of the frame 51, as well as an air vent opening 74 and indent 76 for locking an associated muzzle cap in place (as described in more detail below). The fill ball 60 may be disposed within the ink fill hole 56 to allow for passage of ink into the ink reservoir 50 while preventing leakage of ink out of the ink reservoir 50. The spring 53 may be made from 316 stainless steel or other compatible material, and is used to deliver force to the side plates 54, to generate a back pressure. The side plates 54 may be made of 316 stainless steel or other comparable material, and act as the rigid surface area that generates the back pressure in the system. The side plates 54 may be attached to the spring 53 at either end. In an exemplary embodiment, the side plates 54 may be attached to the side walls 55, though they need not be. The side walls 55 are made of multi-layer polymeric films that are thermally formed and then welded to the sides of the frame 51 to create the chamber needed to store the ink. The polymeric film used to form the side walls 55 may be, for example, thermally formed polypropylene and/or polyethylene film.

During printing, ink is ejected out of the nozzles, causing an increase in negative pressure under the filter 20. This negative pressure pulls ink from above the filter 20 and into the tower 14. Since the ink reservoir 50 is in direct fluid connection with the tower 14, the negative back pressure inside the ink reservoir 50 increases as well. The negative back pressure pulls against the side walls 55 and side plates 54, which causes the spring 53 to collapse further. The spring 53 is what maintains and dictates the static back pressure in the system.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A printhead, comprising:

an ink cartridge body made of polyethersulfone that is compatible with ketone, acetate and alcohol based inks;

an ink reservoir disposed within the ink cartridge body and adapted to receive and contain ink;

a printhead chip provided on the ink cartridge body and in fluid communication with the ink reservoir so as to receive ink from the ink reservoir for ejection of the ink onto a print medium; and a filter in direct contact with the printhead chip that filters ink delivered to the printhead chip.

2. The printhead of claim 1, wherein the ink reservoir comprises:

a frame member;

parallel opposed side walls attached to the frame member;

parallel opposed pressure regulator side plates disposed inwardly relative to the side walls; and a spring member disposed between and in contact with the side plates that biases the side plates away from one another so as to regulate back pressure within the ink reservoir.

3. The printhead of claim 2, wherein the side walls are made of thermally formed polymeric film material.

4. The printhead of claim 2, wherein the side plates are made of stainless steel.

5. The printhead of claim 1, wherein the ink cartridge body comprises a tower portion that defines an ink entrance passage configured to receive ink from the ink reservoir.

6. The printhead of claim 5, further comprising a filter cap disposed over the tower portion, the filter cap defining an ink passage that allows ink to flow from the ink reservoir to the tower portion of the ink cartridge body.

7. The printhead of claim 6, wherein the filter cap is made of nylon.

8. The printhead of claim 6, further comprising a sealing member that forms a seal between the ink reservoir and the filter cap.

9. The printhead of claim 8, wherein the sealing member is a gasket.

10. The printhead of claim 5, wherein the filter is disposed below the tower portion.

11. The printhead of claim 10, wherein the filter is made of at least one of a mesh, screen or weave material.

12. The printhead of claim 11, wherein the filter is made of a weave material, and the weave material is at least one of a metal weave or a polymer weave material.

13. An inkjet printer comprising:

a housing;

a carriage adapted to reciprocate along a shaft disposed within the housing;

one or more printheads arranged on the carriage so that the printheads eject ink onto a print medium as the carriage reciprocates along the shaft in accordance with a control mechanism, wherein at least one the one or more printheads comprises:

an ink cartridge body made of polyethersulfone that is compatible with ketone, acetate and alcohol based inks;

an ink reservoir disposed within the ink cartridge body and adapted to receive and contain ink;

a printhead chip provided on the ink cartridge body and in fluid communication with the ink reservoir so as to receive ink from the ink reservoir for ejection of the ink onto a print medium; and a filter in direct contact with the printhead chip that filters ink delivered to the printhead chip.

14. The inkjet printer of claim 13, wherein the ink reservoir comprises:

a frame member;

parallel opposed side walls attached to the frame member;

parallel opposed pressure regulator side plates disposed inwardly relative to the side walls; and a spring member disposed between and in contact with the side plates that biases the side plates away from one another so as to regulate back pressure within the ink reservoir.

15. The inkjet printer of claim 13, wherein the ink cartridge body comprises a tower portion that defines an ink entrance passage configured to receive ink from the ink reservoir.

16. The inkjet printer of claim 15, wherein the filter is disposed below the tower portion.

17. The inkjet printer of claim 15, further comprising a filter cap disposed over the tower portion, the filter cap defining an ink passage that allows ink to flow from the ink reservoir to the tower portion of the ink cartridge body.

18. The inkjet printer of claim 17, wherein the filter cap is made of nylon.

19. The inkjet printer of claim 17, further comprising a sealing member that forms a seal between the ink reservoir and the filter cap.

20. The inkjet printer of claim 19, wherein the sealing member is a gasket.

* * * * *